United States Patent [19]

Cashel

[11] Patent Number: 4,598,934

[45] Date of Patent: Jul. 8, 1986

[54] REVERSIBLE BOOK HAVING COVER-CONNECTING INSERT

[76] Inventor: Mary E. Cashel, 62 Vernon St., Providence, R.I. 02903

[21] Appl. No.: 797,690

[22] Filed: Nov. 13, 1985

[51] Int. Cl.[4] ..... B42D 19/00; B42D 1/00

[52] U.S. Cl. ..... 281/5; 281/2; 40/124.1

[58] Field of Search ..... 281/2, 5, 27, 45; 402/7; 434/178; 446/47, 48; 282/22 A, 22 R; 40/124.1

[56] References Cited

U.S. PATENT DOCUMENTS

| | | | |
|---|---|---|---|
| 418,455 | 12/1889 | Gray | 281/5 |
| 1,799,490 | 4/1931 | Westerman | 281/5 |
| 2,458,729 | 1/1949 | Politzer | 281/5 |
| 3,517,449 | 6/1970 | Frandsen et al. | 281/5 |

*Primary Examiner*—Paul A. Bell

*Assistant Examiner*—Paul M. Heyrana, Sr.

*Attorney, Agent, or Firm*—Mortenson & Uebler

[57] ABSTRACT

A reversible book is provided having a front cover and a back cover and having pages in the form of a sheet in an accordian fold, the sheet affixed at one end to the front cover and at the other end to the back cover, and having a ribbon-like element anchored at one end to the front cover and anchored at its other end to the back cover, the ribbon passing through vertical slots in each fold of the sheet. The book has no spine, but is held together by the sheet and the ribbon element, on both sides of each of which may appear illustrations and/or a story. The reader proceeds through the book from front cover to back cover, reading material on the front of the sheet and ribbon, and then pulls the back cover around toward him and reads on with the same story or a new story, proceeding from back cover to front cover, reading material which was originally not in view being on the back of the sheet and ribbon first read.

7 Claims, 6 Drawing Figures

REVERSIBLE BOOK HAVING COVER-CONNECTING INSERT

BACKGROUND OF THE INVENTION

This invention relates to a new form of book construction.

A book is in effect a substantial number of printed pages bound together in bulk. The name comes from the old Saxon root boc, a beech, whose derivatives exist in various northern tongues; it recalls an early type of northern book in which slabs of oak, beech, or fir were the covers. But the primitive book can be traced much farther back in the East, where Chaldean inscribed tiles exist 7000 years old and more, whose cuneiform letters were made on soft clay by scribes; the tile was then baked in a kiln. Another ancient type of book was the Egyptian papyrus roll, made from the pith of the reed from which comes the word paper, and put in a roller like a map. It was a perishable material, and few examples have survived. For over ten centuries, papyrus rolls or volumes were in use; and many copies of the same work were often made by a number of scribes who wrote down simultaneously the text dictated by an author or a reader. The papyrus rolls were kept in jars and canisters, or collected in boxes, which served to preserve them from destruction.

As the Chaldean tablet provides the crude idea of a book, varying as books do in size, so the papyrus provides the first idea of the paper page. But the papyrus was unfitted by its brittle texture to be folded, and the next development came when the papyrus sheet gave way to parchment and vellum skins, and the pen was used instead of the style. Books were produced on folded parchment in the eraly medieval religious houses, for long the only publishers. The page became a distinct item with a manuscript symmetry of its own, and the folding of the parchment or vellum into fourfold or other convenient sizes of leaf helped to decide the traditional format and make-up of the ordinary book.

The earliest date to be given for the use of parchment overlaps by centuries the period of the papyrus roll, but it was not freely used until about 500 A.D. Among books that count by their long survival and historical value, the Egyptian Papyrus Prisse and the Book of the Dead may be cited; the former is between 3000 and 4000 years old. Chinese books of proverbial antiquity are to be traced well over 2000 years. They are frequently furnished with leaves of jade inscribed with exquisitely clear script. But in China the book met with a tragic break of history in the 2nd century B.C. when the Burning of the Books in 221 by the first emperor destroyed the labors of 1000 years or more.

As the book developed in Europe, and assumed its conventional lines, it still kept many of the terms given it by its original beginners. It remained a volume because the old parchment roll was wound on a stick, and it retained its leaves, its paper, and its boards. When paper was first made, the writing kept its old character; but the art of the Celtic and Latin scribes was preferred to the German script when the earliest font of Latin type was cut. This resulted in the modern style of printing.

Although the origin of bookbinding is uncertain, the art is one of great antiquity. English bindings have come down from the 10th century, and many examples from the 11th and 12th. Originally all manuscript was rolled.

Bookbinding proper began when the sheets were first folded to form leaves of uniform size, sewed together, and fastened between covers.

In the earliest examples still preserved, the covers were made of wood, usually covered with leather ornamented with various designs. The work, like that of manuscript, was entirely in the hands of the various religious orders, who lavished great care upon it. In the 12th, 13th, and 14th centuries, books were frequently bound in ivory or gem-studded metal.

Books, as a rule, are supplied by the printer to the binder in sheet sections made up of 64 to 128 pages. The printed pages are arranged so that they will lie in their proper order when folded. On the saddle of each outside sheet section is printed a collating mark. The sheets, as folded in 16- or 32-page foldings, are called signatures. The first and last signatures of a book go through tipping and stripping machines, where they are pasted along the inside to the linings, or end sheets, and are reinforced with cambric, drill, etc., to give them strength, and the book is then finally bound between covers.

Books having inserts or "pop ups" which literally pop up out of the book when opened, as well as greeting cards having similar pop ups are known. And, finally, books in the classic Chinese style having no spine and having accordian-like folded pages are also known, the latter being the closest known prior art.

SUMMARY OF THE INVENTION

A book is provided comprising a front cover and a back cover and an elongate sheet having two ends and two sides, the sheet being folded into a multiplicity of substantially uniform accordian-like folds to form the pages of the book, one end of the sheet being affixed to the front cover of the book and the other end of the sheet being affixed to the back cover, the sheet having vertical slot-like openings through each of the pages, and including a ribbon-like element having two ends, one end of the ribbon being anchored to the front cover and the other end of the ribbon being anchored to the back cover, the ribbon extending through each of the vertical slots in the pages. The book may have at least one illustration on the ribbon-like element, text on the pages, or illustrations on both sides of the ribbon-like element and the pages. The ribbon-like element may be made of paper or, preferably, of a durable plastic material.

Figure 2:
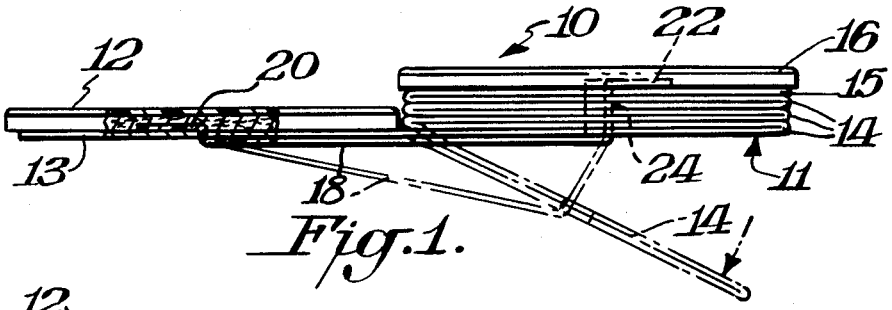
FIG. 2 is a top plan view, partly broken away, of the book of the invention.

DETAILED DESCRIPTION OF THE INVENTION AND PREFERRED EMBODIMENTS WITH REFERENCE TO THE DRAWINGS

A reversible book is provided having a front cover and a back cover and having pages in the form of a sheet in an accordian fold, the sheet affixed at one end to the front cover and at the other end to the back cover, and having a ribbon-like element anchored at one end to the front cover and anchored at its other end to the back cover, the ribbon passing through vertical slots in each fold of the sheet. The book has no spine, but is held together by the sheet and the ribbon element, on both sides of each of which may appear illustrations and/or a story. The reader proceeds through the book from front cover to back cover, reading material on the front of the sheet and ribbon, and then pulls the back cover around toward him and reads on with the same story or a new story, proceeding from back cover to front cover, reading material which was originally not in view being on the back of the sheet and ribbon first read.

The front paste down and the back paste down are integral with the accordian folded sheet that makes up the pages. The pages do not turn in the usual sense, for they are not cut apart. Each fold forms the front and the back of two consecutive pages.

Each fold has a vertical slot or opening therein. The ribbon-like element, anchored at one end to the front cover and at the other end to the back cover, acts in conjunction with the paste downs of the sheet to bind the book or hold it together. The ribbon-like element, in going from the front of the book to the back, passes through each of the vertical slots.

Printed or illustrated matter can appear on the paste downs and on both sides of the ribbon-like element and on both sides of the accordian folded sheet. As each fold is turned over, the illustration on the ribbon-like element appears on the next fold or page as an illustration. Thus, the background illustrations and printed matter change as the pages are turned, while the illustration on the ribbon-like element remains the same.

The back sides of the ribbon-like element and the accordian folded sheet also can contain printed text or illustrations or both. When the reader proceeds from the front to the back of the book, he pulls the back cover around toward him causing it to become a new "front" cover. The story may continue on or a new story may begin, thereby providing, in effect, two books. The reader then proceeds through the book again from the new "front" cover (the back cover) to the new "back" cover (the front cover) and a new book is read, that is, the reader is now reading the material that was not read in the first reading since it is on the back sides of the ribbon-like element and the accordian folds during the first trip.

In the ordinary "pop-up" book the material that "pops up" does so literally and appears in a standing form, that is, perpendicular to the pages of the book. It is that action that gives the name "pop-up". The material that rises up does not run through the book and is generally best viewed with the book held horizontally. In the device of this invention, the flexible ribbon runs from cover to cover and reading material on it is easily and completely readable with the book in the ordinary reading position. This is so because the ribbon in operation lies substantially in a plane parallel to the plane of the page being read.

The material appearing on the sheet or pages and on the ribbon may be illustrations, prose, poetry, text or indicia of any kind desired. Thus, the device of this invention finds use in a variety of fields including the childrens' books and the advertising markets.

A detailed description of the book and preferred embodiments is best provided by reference to the accompanying drawings.

Figure 1:
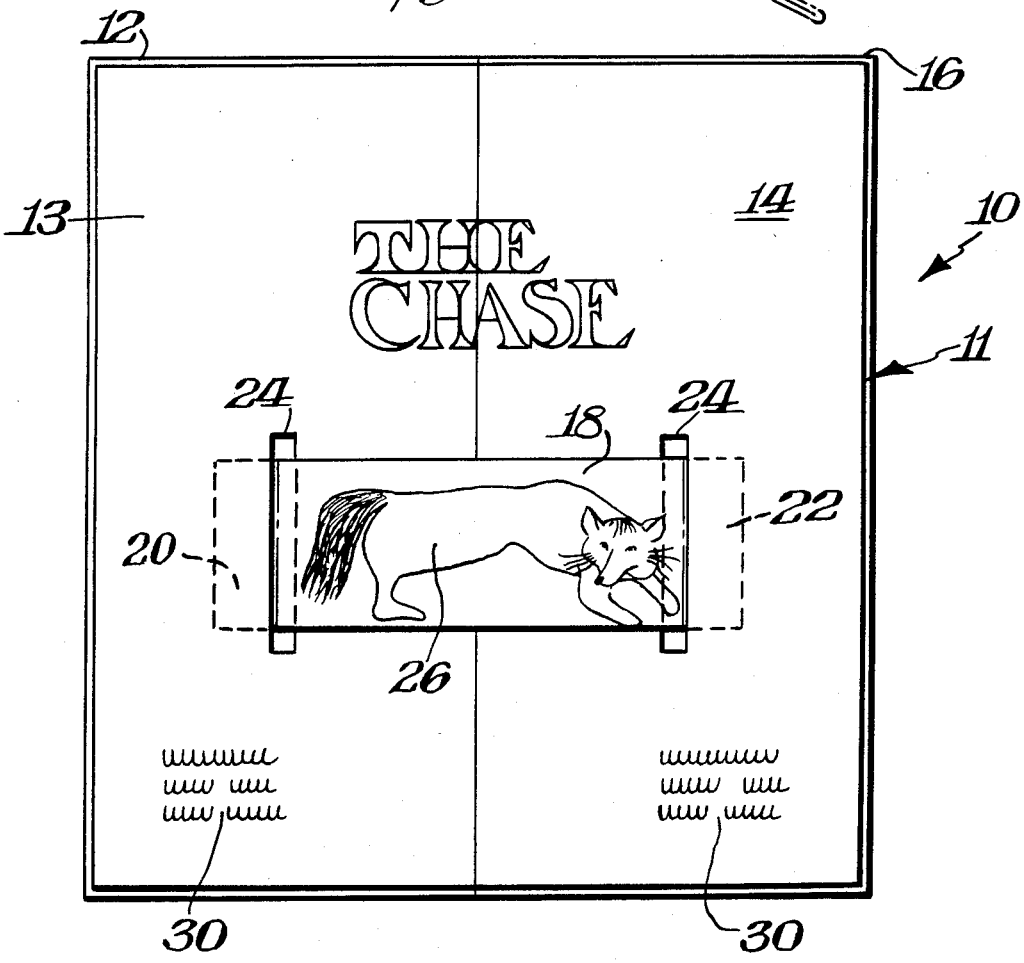
FIG. 1 is a front elevation of the book of the invention opened to the front page.

FIG. 1 shows a front elevational view of the book 10 according to the invention open to the front paste down 13 anchored to the front cover 12, and the first "page" or front side of the first fold 14 in sheet 11. Ribbon-like element 18 is anchored to the front cover 12 by anchor means 20, which can be glue, and the ribbon 18 passes through the vertical slots 24 in the front paste down 13 and in the folded pages 14 and in the back paste down where it is anchored to the back cover 16 by anchor means 22. The ribbon element 18 shown in FIG. 1 has an illustration 26 of a fox on its front side. The front paste down 13 and the pages 14 may contain printed text 30.

FIG. 2 is a top plan view of the book 10 showing how the folded pages 14 of sheet 11 are turned. The first fold 14 is being opened as indicated by the arrow. The sheet 11 comprises the front paste down 13 anchored to the front cover 12, several folded pages 14, and back paste down 15 anchored to the back cover 16. The ribbon-like element 18 is anchored to the front cover 12 by anchor means 20, passes through the slots 24 in the pages 14 and is anchored to the back cover 16 by anchor means 22.

Figure 3:
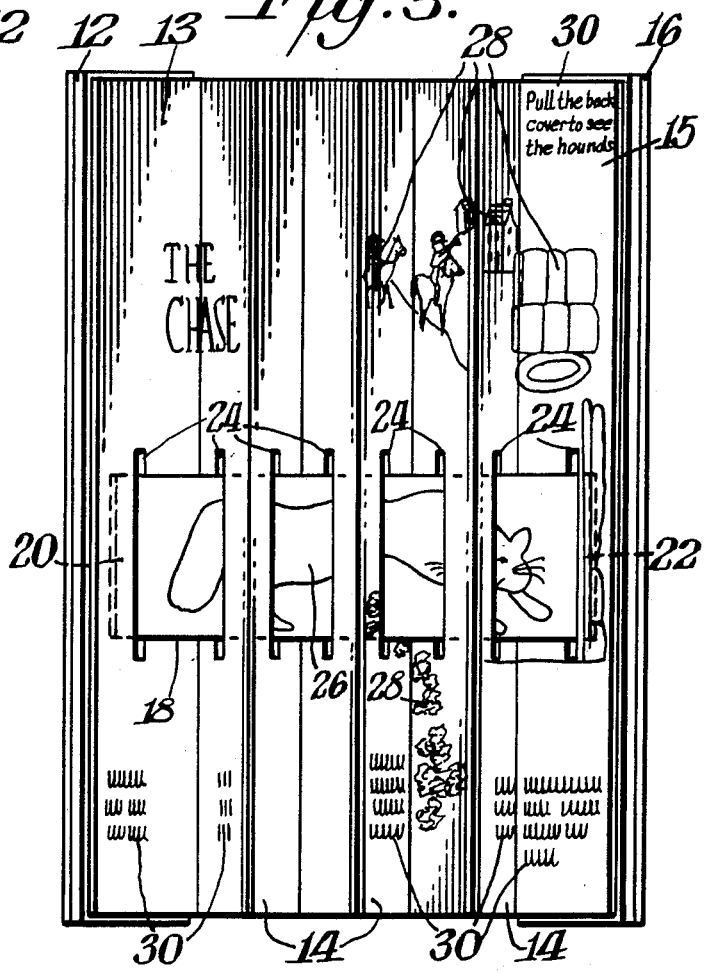
FIG. 3 is a front elevation of the book open to show the front of the accordian folded sheet which forms the pages of the book.

FIG. 3 is a front elevational view of the book in a partially opened position showing several pages. The ribbon-like element 18 is anchored to front cover 12 by anchor means 20 and passes through the vertical slots 24 in the pages and is anchored to the back cover 16 by anchor means 22. Also shown for completeness are the illustration 26 on the front of ribbon-like element 18, background illustration 28 on the front of one page and text 30.

Figure 4:
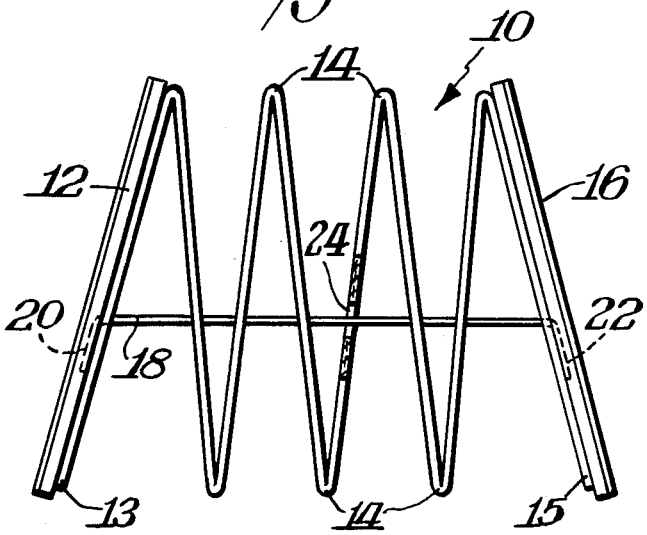
FIG. 4 is a top plan view of the open book, partly broken away to show a vertical slot in a page.

FIG. 4 is a top plan view, partially broken away, showing the book in a partially open position. The ribbon element 18 is shown in the portion broken away extending through vertical opening 24 in one of the folded pages 14 of sheet 11.

Figure 5:
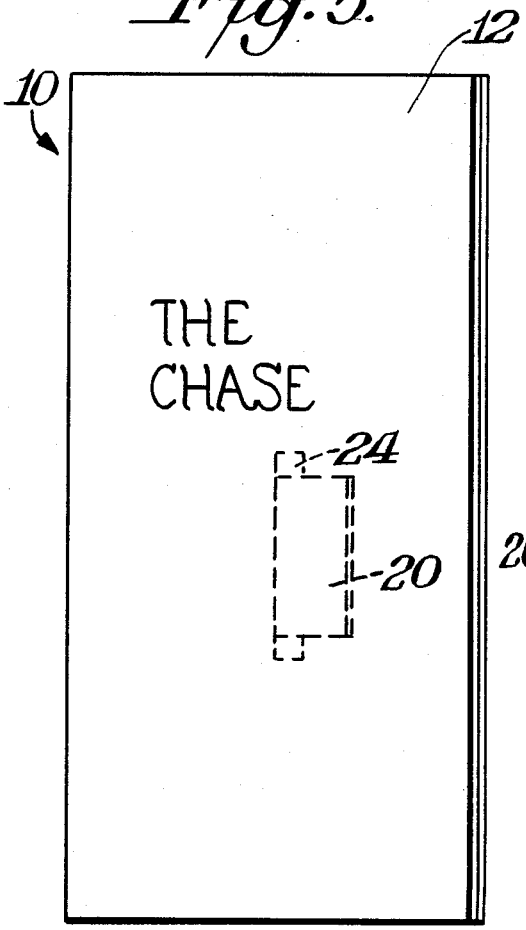
FIG. 5 is an elevational view showing the left side or front cover of the book.

FIG. 5 is a left side elevational view showing the front cover of the book and, in phantom, anchor means 20 and vertical slot 24.

Figure 6:
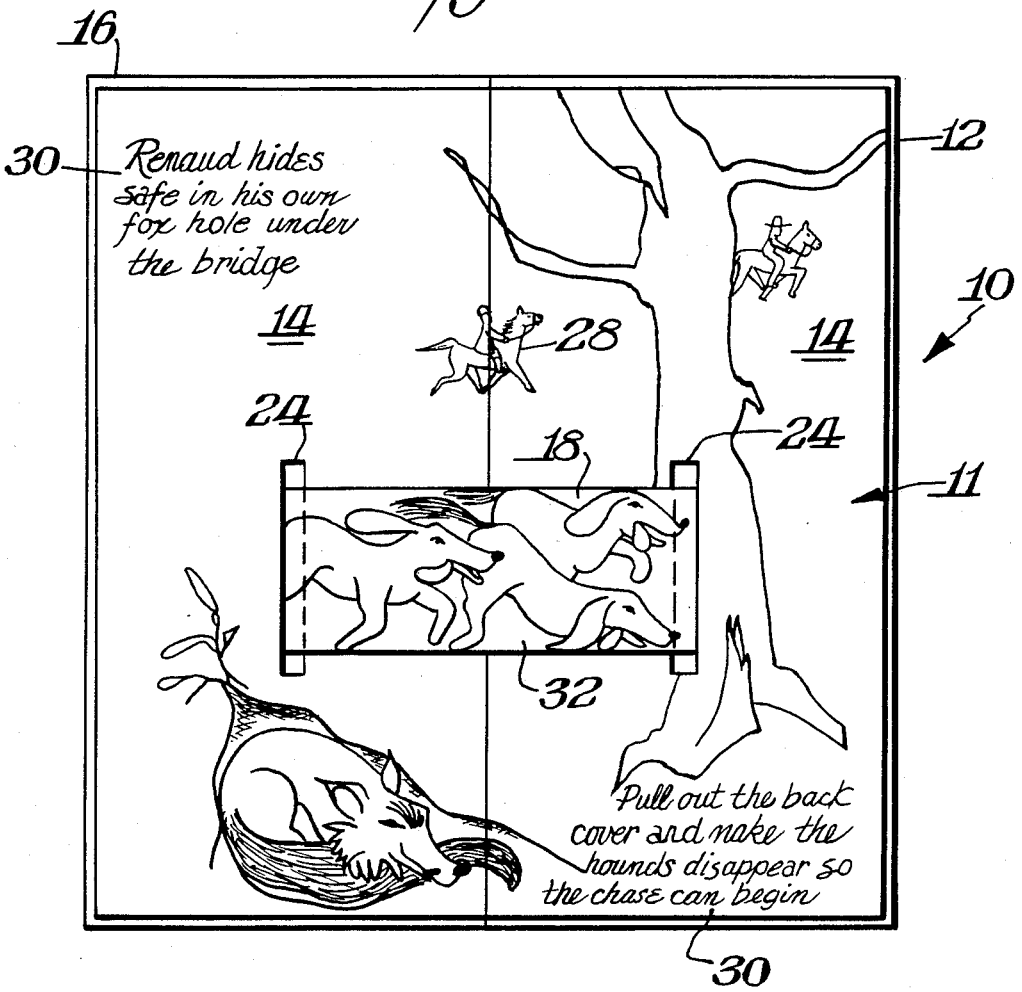
FIG. 6 is a rear elevation of the book open to show the back cover after it has been pulled around to expose the back side of the ribbon element.

FIG. 6 is a rear elevation similar to FIG. 1 showing the book 10 open to view the rear side of ribbon element 18 which, in this case, has an illustration 32 of hounds thereon, and printed text 30. From this position, the reader proceeds through the book reading what originally appeared on the back side of sheet 11.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A book comprising a front cover and a back cover and an elongate sheet having two ends and two sides, said sheet being folded into a multiplicity of substantially uniform accordian-like folds to form the pages of said book, one end of said sheet being affixed to said front cover and the other end of said sheet being affixed to said back cover, said sheet having vertical slot-like openings through each of said pages, and including a ribbon-like element having at least one illustration thereon and having two ends, one end of said ribbon being anchored to said front cover and the other end of said ribbon being anchored to said back cover, said ribbon extending through each of said vertical slots in said pages.

2. The book of claim 1 having text on at least one of said pages.

3. The book of claim 1 having illustrations on both sides of said ribbon-like element.

4. The book of claim 1 wherein said ribbon-like element is of paper.

5. The book of claim 1 wherein said ribbon-like element is of a plastic material.

6. The book of claim 1 which is reversible.

7. The book of claim 6 which contains indicia on both sides of said pages and said ribbon.

* * * * *

UNITED STATES PATENT AND TRADEMARK OFFICE

CERTIFICATE OF CORRECTION

PATENT NO. : 4,598,934

DATED : July 8, 1986

INVENTOR(S) : Mary E. Cashel

It is certified that error appears in the above-identified patent and that said Letters Patent is hereby corrected as shown below:

In col. 1, line 35, "eraly" should read —early—.

Signed and Sealed this

Fourth Day of November, 1986

[SEAL]

*Attest:*

DONALD J. QUIGG

*Attesting Officer*

*Commissioner of Patents and Trademarks*